United States Patent [19]

Benton et al.

[11] 4,342,178

[45] Aug. 3, 1982

[54] CARBON ANODE FURNACE COVER CONSTRUCTION

[75] Inventors: Charles M. Benton, Hawesville; Franklin D. Arnold, Owensboro; George W. Kellogg, Hawesville; Roger D. Kirk, Owensboro, all of Ky.

[73] Assignees: National Steel Corp., Pittsburgh, Pa.; Southwire Co., Carrollton, Ga.

[21] Appl. No.: 119,918

[22] Filed: Feb. 8, 1980

[51] Int. Cl.[3] ..... B66C 1/66; F23M 7/00

[52] U.S. Cl. ..... 52/125.5; 52/600; 110/173 A; 294/89; 432/250

[58] Field of Search ..... 432/250; 110/173 A; 52/125, 596, 600, 707, 706, 698, 602; 266/280; 294/89

[56] References Cited

U.S. PATENT DOCUMENTS

| | | | |
|---|---|---|---|
| 1,624,386 | 5/1927 | Betts | 52/125 |
| 2,703,003 | 3/1955 | Ruppel | 52/602 |
| 2,772,560 | 12/1956 | Neptune | 52/125 |
| 3,355,160 | 11/1967 | Given | 266/280 |
| 3,808,085 | 4/1974 | Givens | 52/600 |
| 4,179,151 | 12/1979 | Tye | 52/125 |
| 4,210,086 | 7/1980 | Smith | 110/173 A |

*Primary Examiner*—John E. Murtagh

*Attorney, Agent, or Firm*—Herbert M. Hanegan; Stanley L. Tate; R. Steven Linne

[57] ABSTRACT

A pit cover for retaining heat in an open top, ring-shaped, carbon anode baking furnace comprises an insulating cement cast into the form of the cover, at least one metal beam embedded in the insulating cement, and a plurality of stainless steel needles interspersed substantially throughout the insulating cement for reinforcement purposes. The insulating cement has a K factor of approximately 2 to 4, a density of approximately 80 to 100 lb./ft.$^3$, a cold crushing strength in the range of 1,000 to 5,000 psi, and a low iron content, preferably, less than 2%.

11 Claims, 9 Drawing Figures

CARBON ANODE FURNACE COVER CONSTRUCTION

BACKGROUND OF THE INVENTION

1. Field of the Invention

This invention relates to heating and heat retaining work chamber structures, in particular, to covers and masonry with metallic supports therein.

2. Description of the Prior Art

The reason for using a pit cover over an open top carbon anode baking furnace is the same as for using a lid on a cooking pan-heat retention. Open top furnaces for baking carbon anodes immersed in fluid coke were designed some time ago when natural gas was cheap and plentiful. Now that this is no longer the case because prices are higher and supplies are not so plentiful, the inefficient utilization of energy for heating the furnaces has become an economic problem to be overcome.

One way to overcome this problem is to employ pit covers over the carbon anode baking furnaces which previously had open tops. Without pit covers, only four carbon anodes could be stacked in a row because the top carbon anode could not be too close to the surface of the fluid coke. If the top carbon anode was not immersed deeply enough in the fluid coke, it would not get sufficiently hot and, therefore, would not be baked properly for subsequent use as a good electrical conductor in reducing alumina to aluminum.

Pit covers per se are known and are exemplified by the unnumbered elements shown incidentally but not discussed in U.S. Pat. No. 4,131,417, issued to Donald D. Dwight on Dec. 26, 1978, and assigned to Aluminum Company of America, Pittsburgh, Pa.

The insulative properties of pit covers that are simply concrete slabs are minimal at best. Because the slabs are placed directly on top of the fluid coke, they do not effectively seal the surface of the furnace. Since the furnace is being run in a partial vacuum, outside room air is drawn into the furnace through the cracks left between the slabs and the walls near the top surface of the furnace. This outside room air cools the fluid coke and the top carbon anode. More fuel is, thus, unnecessarily wasted in heating the top carbon anode. A pit cover that would effectively seal the top surface of the furnace would reduce fuel consumption.

Efforts by others to make a suitable pit cover out of insulative castable refractory material which would effectively seal the furnace and reduce fuel consumption have met with failure. Thus, generally speaking, the carbon anode baking industry has turned away from the use of such materials and has attempted to solve the problems discussed above by other means. The failure of the industry and its search in other directions is discussed in U.S. Pat. No. 4,097,228, issued to Denys R. Rosling on June 27, 1978, and assigned to Babcock & Wilcox Co., New York, N.Y. This patent describes a flexible insulating blanket made of ceramic fiber and attached to a metal backing with adjustable panels thereon for sealing the open top of a carbon anode baking furnace. However, this type of pit cover is difficult to handle and time consuming to install. They are expensive to manufacture and the flexible insulating blanket made of ceramic fiber does not hold up in service.

Thus, it still remains a problem in the carbon anode baking industry to make a pit cover which will effectively seal the open top of the furnace and will significantly reduce fuel consumption.

SUMMARY OF THE INVENTION

The invention relates to a pit cover which effectively seals the open top of a furnace used for baking carbon anodes immersed in fluid coke and a method of making such a pit cover.

It is a primary object of the invention to significantly reduce up to 16% of the consumption of fuel, in particular, natural gas, utilized in the heating of such open top carbon anode baking furnaces.

It is also an object of the invention to increase the production of baked carbon anodes by 25% by stacking five instead of four unbaked carbon anodes in each row inside the furnace before the baking process begins.

It is a further object of the invention to improve the safety of the environment for workers in a carbon anode baking foundry by placing pit covers over the open top furnaces. Fluid coke is a very good packing material. However, it will not support any weight and acts like quicksand. If a worker fell into it when the furnace is being heated to temperatures up to 1100° C., he or she would be injured or killed.

It is a further object of the invention to increase the useful life of a pit cover up to four years by using insulative cement cast into the form of the pit cover. A satisfactory cement should have a good ability to insulate, a certain density, a particular range of cold crushing strength, and a low iron content.

Finally, it is an object of the invention to reduce pollution emissions at the smokestack by controlling the draft through the furnace. Effectively sealing the open top of the furnace improves the control of the draft and, thus, aids in the reduction of the pollution emissions. Such reduction in pollutants was an unexpected favorable result which occurred because of the use of the pit covers.

Briefly stated, the present invention relates to a pit cover and a method of making such a pit cover for retaining heat in an open top furnace in an efficient and safe manner.

More particularly, the pit cover for retaining heat in the furnace comprises an insulative cement cast into the form of the cover, at least one metal beam embedded in the insulative cement, and a plurality of needles which are interspersed substantially throughout the insulative cement for reinforcing such insulative cement. The cover also comprises means for allowing pick up of the cover and means for anchoring the metal beam and the insulative cement together.

The means for allowing pick up is a hollow pipe section having at least one slot arranged in a side wall of the pipe section for engagement with a pick up device. Preferably, there are two steel I-beams arranged approximately parallel to and longitudinally spaced from each other in the insulative cement. The insulative cement has a K factor of approximately 2–4, a density of approximately 80 to 100 pounds per cubic foot, a cold-crushing strength in the range of 1,000 to 5,000 pounds per square inch, and a low iron content. The iron content is mainly iron oxide and makes up less than 2% of the total amount of the insulative cement. The needles are made of stainless steel and are two inches long, one-tenth inch wide, and one-one hundredth inch thick.

Also, more particularly, the method of making the pit cover for retaining heat in a carbon anode baking furnace comprises the steps of casting the insulative cement into the form of the cover, embedding at least one metal beam in the insulative cement, and interspersing a plurality of needles for reinforcing the insulative cement substantially throughout. The method also comprises the steps of connecting means for allowing pick-up of the pit cover to the at least one metal beam and attaching means for anchoring the metal beam and the insulative cement together to the at least one metal beam.

DETAILED DESCRIPTION OF THE PREFERRED EMBODIMENT

Figure 1:
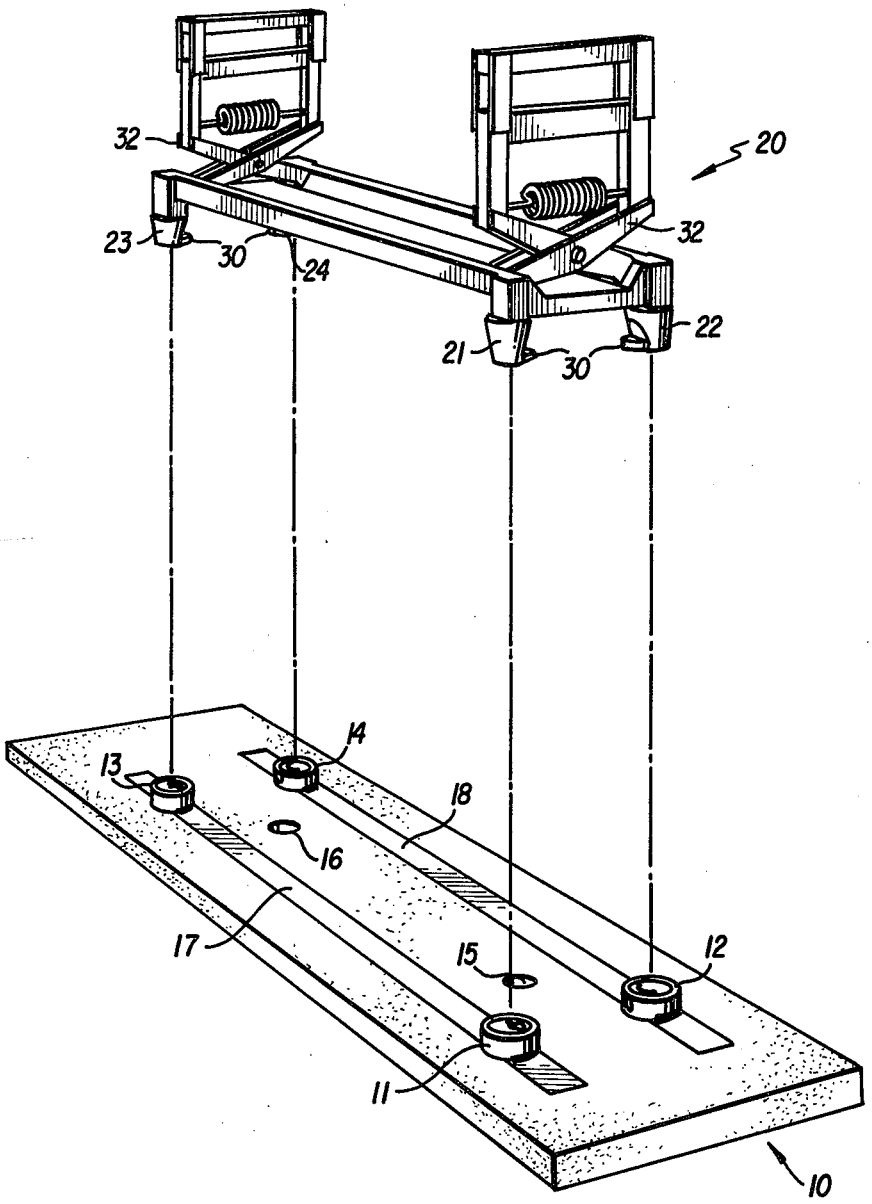
FIG. 1 is an exploded perspective view of a pit cover constructed in accordance with this invention and depicts a lifting device having spring-biased tongs aligned over pick-up pipes of the pit cover.

In FIG. 1, there is shown a perspective view of a pit cover 10 cast from insulative cement and having pick-up pipes 11–14 welded to respective steel I-beams 17 and 18. The pick-up pipes 11–14 enable the pit cover 10 to be lifted by means of a lifting device 20 which is carried by an overhead crane (not shown). Peepholes 15 and 16 allow the foundry workers to view the interior of the furnace under the pit cover 10.

Figure 2:
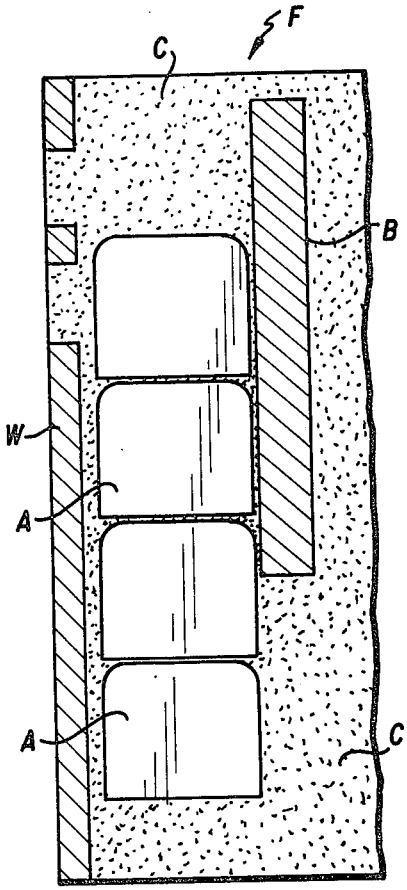
FIG. 2 is a fragmentary vertical sectional view taken through a prior art open top furnace without a pit cover, and depicts four carbon anodes immersed in fluid coke for baking therein.

In FIG. 2, the prior art arrangement of four carbon products, such as 1,700 pound blocks of amorphous carbon pressed into anodes A, are shown aligned in a stack inside an open-top furnace F filled with fluid coke C. The anodes A are immersed in this fluid coke C. Also in FIG. 2, the furnace F is shown in cross-sectional view with wall W and baffle B so arranged as to contain each stack of anodes A and to separate each stack from the adjoining stack (not shown).

Figure 3:
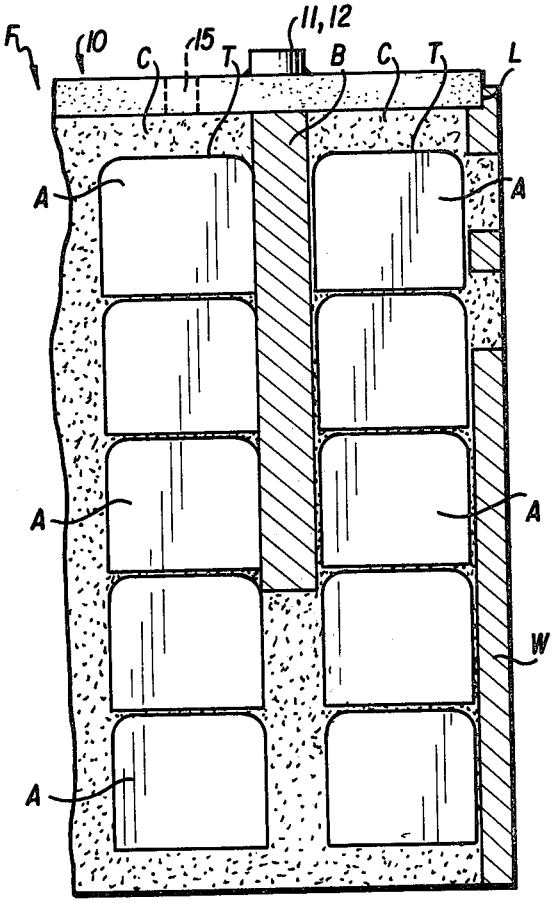
FIG. 3 is a fragmentary vertical sectional view taken through a furnace covered with the pit cover of this invention and depicts five carbon anodes immersed in fluid coke for baking therein.

However, in FIG. 3, the present arrangement of five carbon products, such as anodes A, are shown aligned in adjoining stacks inside the furnace F filled with fluid coke C in which the anodes A are immersed. The furnace F is capped by the pit cover 10, shown in a partial cross-sectional view, with pick-up pipes 11 and 12 and peephole 15. A ledge L, formed at the top of the wall W, acts as a notch in which the pit cover 10 may fit along its sides and bottom. The fit of the pit cover 10 on ledge L is an effective seal at the top of the furnace F so that relatively cool outside air is not drawn into the top of the furnace F which may reach temperatures up to 1100° C.

Figure 4:
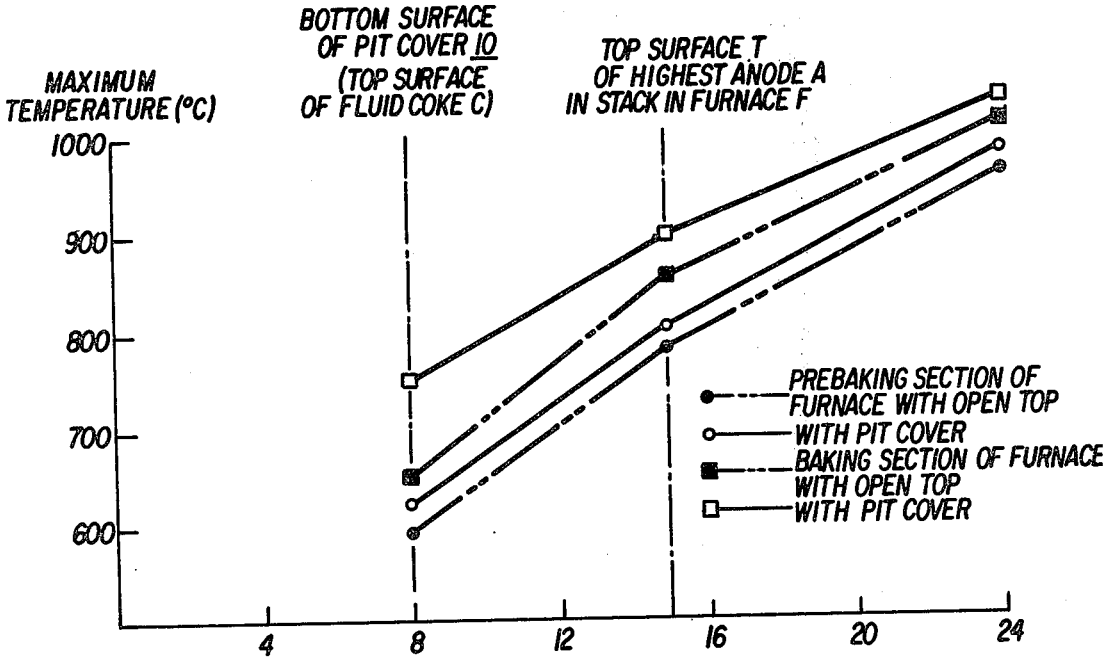
FIG. 4 is a graph of the maximum furnace temperatures in the top two feet of fluid coke in a baking and a prebaking stage with and without the pit cover of the present invention.
Figure 5:
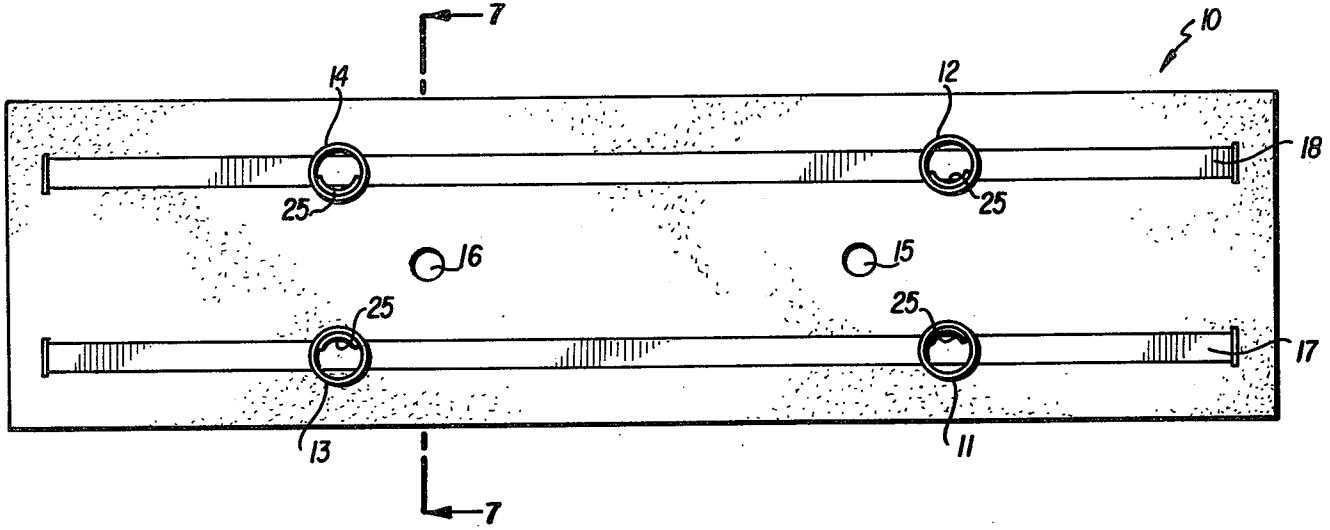
FIG. 5 is a top plan view of the preferred embodiment of the pit cover of this invention.
Figure 6:
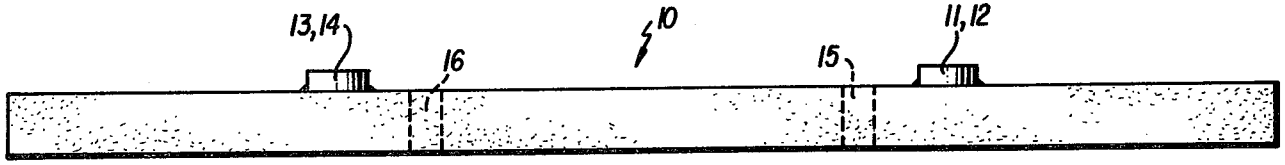
FIG. 6 is a side view of the preferred embodiment of the pit cover illustrated in FIG. 5.

In FIG. 4, a graph shows the maximum temperature in two feet of fluid coke C laying near the top of the furnace F in baking and prebaking stages. When the pit cover 10 is in place, higher temperatures are obtained in both baking and prebaking stages, as is shown by the solid lines in the graph. When the furnace is operated with an open top, lower temperatures are obtained in both baking and prebaking stages, as is shown by the dashed lines in the graph. Thus, when the pit cover 10 is used, the top surface T, as shown in FIG. 3 and schematically in FIG. 4, of the highest anode A in any stack is hotter than in those operations in which the pit cover 10 is not used. Therefore, more fuel must necessarily be used when the furnace is operated with an open top or with less effective sealing covers as there are now in use in prior art arrangements. Field tests of furnace operatins with open tops and with the pit covers 10 of the present invention have shown a fuel savings of about 16%.

Figure 8:
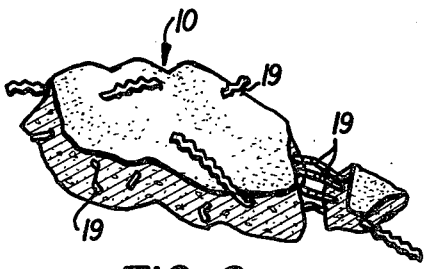
FIG. 8 is a fragmentary perspective view of the pit cover cast from insulative cement and illustrates a plurality of needles interspersed throughout.
Figure 7:
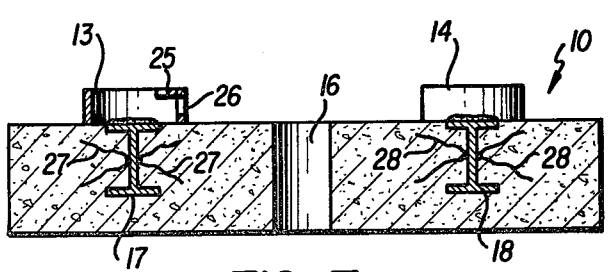
FIG. 7 is a cross-sectional view taken along line 7—7 of FIG. 5 and illustrates the internal construction of the pit cover.

The internal detailed construction of the pit cover 10 is seen most clearly in FIG. 7. Thin metal sheets 27 and 28 are embedded in the cement and are affixed to the beams 17 and 18 and extend longitudinally thereof in order to help anchor the steel I-beams 17 and 18, respectively, into the insulating cement. Stainless steel needles 19 shown in FIG. 8 are interspersed substantially throughout the insulating cement of the pit cover 10 for reinforcement purposes but, for purposes of clarity, have not been shown in FIG. 7.

Figure 9:
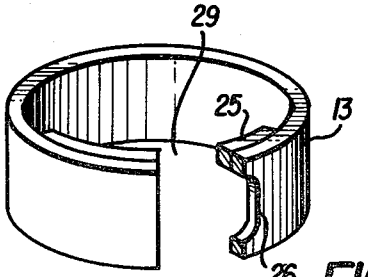
FIG. 9 is a detailed cutaway perspective view of one of the pick-up pipes of the pit cover.

The pit cover 10 is adapted to be raised and lowered by lifting device 20 carried by an overhead crane. See FIG. 1. The lifting device 20 includes a pair of spring-biased tongs 32 having cylindrical-shaped dogs 21–24 depending therefrom which are adapted to engage in the pick-up pipes 11–14 of the cover 10. Tips 30 extend from each of the dogs 21–24 for interengaging under the lips 25 and in the slots 26 of each of the pipes 11–14. See FIG. 9, in particular.

The pit cover 10 is made and used in the following manner. First, in order to manufacture the pit cover 10, a wooden form is built to contain the insulative cement which is to be cast into the shape of the pit cover 10. An exemplary pit cover form could be 8 inches high, 33 inches wide, and 128 inches long, thus containing about twenty cubic feet of material.

Preferably, two steel I-beams 17 and 18, being about ten feet long and four inches high, are laid parallel to each other in the bottom of the form in a position so that the longitudinal spacing between the I-beams 17 and 18 matches the spacing between each pair of depending cylindrical dogs 21–22 and 23–24 on the tongs 32. Preferably, beforehand, metal sheets 27 and 28 have been welded to the sides of the I-beams as shown in FIG. 7, so that both I-beams 17 and 18 and both metal sheets 27 and 28 will be embedded in the insulative cement. These sheets 27 and 28, attached to the metal beams 17 and 18, anchor the metal beams 17 and 18 and the insulative cement together.

An insulative cement is then chosen to be mixed with water. As shown in FIG. 8, a plurality of thin, stainless steel, corrugated, ribbonlike needles 19 are interspersed thoroughly throughout the mixture in a conventional cement mixer. Preferably, the thin needles 19 make up about four percent by weight of the cement mixture. These needles 19 have been found adequate for reinforcing the cement to the point where the useful life of the pit cover 10 is doubled from two to four years.

For purposes of sustaining temperatures up to 900° C. over regular heating and cooling down cycles of four years, the chosen insulative cement should have the following characteristics: first, a good ability to insulate, i.e., a K factor of approximately 2 to 4; a light weight, i.e., a density of approximately 80 to 100 pounds per cubic foot (lb./ft.$^3$); good strength, i.e., a cold crushing strength in the range of 1,000 to 5,000 pounds per square inch (psi); and a low iron content, i.e., ferric oxide (FeO) and ferrous trioxide ($Fe_2O_3$) making up less than 2% of the total amount of the insulative cement.

Materials with low K factors make better insulators. For example, fiberglass has a K factor of 0.5 and common clay brick has a K factor of 3. Materials with high K factors are good heat conductors. Therefore, an insulative cement with a K factor of approximately 2 to 4 is preferred.

The chosen insulative cement must contain a low percentage of iron and iron oxide. The fluid coke C is heated above 750° C. next to the pit cover 10. This extremely hot fluid coke C is in direct contact with the bottom surface of the pit cover 10. At this high temperature, carbon monoxide (CO) is formed and reacts with iron (Fe) and iron oxides, such as FeO and $Fe_2O_3$. Such chemical reactions destroy the structural integrity of the cast insulative cement forming the pit cover 10. Therefore, the insulative cement should have an iron content as low as possible. A content of 2% of the total amount of cement has been found to be the maximum allowable level at which the useful life of the pit cover 10 will remain at four years. In other words, if much more iron than 2% of the total amount of cement is added to the pit cover 10, it becomes easy for hot air containing oxygen in the furnace F to attack the iron and form iron oxides, such as FeO and $Fe_2O_3$. These iron oxides or rusts reduce the useful life of the pit cover 10 to unacceptable levels.

As shown in FIG. 8, the needles 19, interspersed throughout the insulative cement, are preferably two inches long, 1/10 inch wide, and 1/100 inch thick. These needles 19 may be of the type used in casting airport runways and concrete highways subject to very high wear. They add greatly, by a factor of 2 to 3, to the strength of the pit cover 10 without detracting from the K factor or insulative ability of the cement mixture.

Before the mixture of insulative cement, needles 19, and water is poured into the wooden form, cylindrical blocks (not shown) are placed in appropriately spaced locations so that peepholes 15 and 16 will be formed in the cast insulative cement.

After the mix is cured, the cylindrical blocks are knocked out of the cast cement and the pick-up pipes 11–14 may be welded onto the I-beams 17 and 18, as shown in FIGS. 1 and 5–7. These pipes 11–14, connected to the metal beams 17 and 18, allow pick-up of the pit cover 10. When this operation is done, the pit cover 10 is completed and is ready for use. Since the completed pit cover 10 weighs about 1400 pounds, it is necessary to move it initially by a fork lift truck from the manufacturing site to the furnace F.

The utilization of the pit cover 10 will now be described. Before the first use of the pit cover 10, the furnace F is loaded from its open top with carbon products, such as anodes A, in stacked rows. Fluid coke C is then poured into the furnace F up to the ledge L in FIG. 3.

As shown in FIG. 1, the dogs 21–24 on the tongs 32 of the lifting device 20 are lowered into engagement with the respective pick-up pipes 11–14 of the pit cover 10. The tips 30 on the dogs 21–24 are withdrawn inwardly by conventional electronic controls manipulated by the operator of the crane 20 and are so retained until the dogs 21–24 descend into hollow central chambers 29 of the respective pick-up pipes 11–14. See FIGS. 1 and 9, in particular. The pipes 11–14 for allowing pick-up of the pit cover 10 are hollow pipe sections having a slot 26 arranged in a side wall of each pipe section for engagement with the dogs 21–24. Once the dogs 21–24 are projecting partially inside the hollow central chambers 29 of the respective pick-up pipes 11–14, the operator of the overhead crane 20 releases the tips 30 from their retained inward position so that they spring outwardly and engage under the lip 25 and into the slot 26 of each pick-up pipe 11–14. For example, see pipe 13 shown in the cutaway perspective view of FIG. 9. The mechanism for releasing the tips 30 on dogs 21–24 attached to tongs 32 of the overhead crane 20 is controlled by conventional electrical circuitry and is not shown in the drawings.

After all four dogs 21–24 are in engagement with all four pick-up pipes 11–14, the pit cover 10 may be lifted by the overhead crane 20 and moved onto the ledge L so that the open top of the furnace F is capped. The furnace F is now ready to be fired by the burners (not shown).

In a carbon anode baking furnace F, a plurality of sections are arranged as links in a ring, also not shown. Each section is fired in a first prebaking stage from room temperature to 300° C. for 48 continuous hours, in a second prebaking stage from 300° C. to 600° C. for another 48 continuous hours, in a third prebaking stage from 600° C. to 900° C. for an additional 48 continuous hours and lastly, in a baking stage from 900° C. to 1100° C. for a final 48 continuous hours. Thereafter, the firing burners are moved away and the furnace F is allowed to cool to room temperature.

The pit cover 10 is lifted off the furnace F by the overhead crane 20 and the fluid coke C is vacuumed out of the furnace F so that the baked anodes A may be removed. The baking process is then ready to be repeated.

It may be readily seen that the bottom of the pit cover 10 is subjected to intense heat for about eight consecutive days over regular intervals of time. Field tests have demonstrated that the projected useful life of each pit cover 10 is approximately four years.

The foregoing preferred embodiment is considered as illustrative only. Numerous modifications will readily occur to those skilled in the art.

What we claim is:

1. A cover construction for use with a carbon anode baking ring furnace which is subject to repeated heat cycling, said cover construction comprising:

a. an insulative cement cast into the form of the cover;

b. at least one metal beam embedded longitudinally within said insulative cement such that the upper surface thereof is exposed;

c. pickup means, connected to the exposed upper surface of the at least one metal beam embedded in the hardened cement, said pickup means including a hollow metal pipe section having at least one slot means arranged in a side wall of said pipe section for engaging a pickup device; and d. a multiplicity of elongate needle means, substantially uniformly dispersed throughout said insulative cement in random orientation, for reinforcing said insulative cement.

2. A cover construction according to claim 1, further comprising:

means, attached to said at least one metal beam embedded in said insulative cement, for anchoring said metal beam and said insulative cement together.

3. A cover construction, according to claim 1, wherein:

said at least one metal beam embedded in said insulative cement includes two steel I-beams arranged approximately parallel to and longitudinally spaced from each other.

4. A cover construction, according to claim 1, wherein:

said insulative cement has a K factor of approximately 2 to 4.

5. A cover construction, according to claim 4, wherein:

said insulative cement has a density of approximately 80 to 100 $lb/ft^3$.

6. A cover construction, according to claim 5, wherein:

said insulative cement has a cold crushing strength in the range of 1000 to 5000 PSI.

7. A cover construction, according to claim 6, wherein:

said insulative cement has a low iron content.

8. A cover construction, according to claim 7, wherein:

said iron content is mainly $Fe_2O_3$ and, further, is less than 2% of the total amount of said insulative cement.

9. A cover construction, according to claim 1, wherein:

said needle means are made of stainless steel.

10. A cover construction, according to claim 1, wherein:

said needle means made of stainless steel have a nominal size of $2'' \times 0.1'' \times 0.01''$.

11. A cover construction, according to claim 1, wherein:

said needles comprise about 4 percent by weight of the insulative cement mixture.

* * * * *